US010789900B2

(12) United States Patent
Kim et al.

(10) Patent No.: US 10,789,900 B2
(45) Date of Patent: Sep. 29, 2020

(54) DISPLAY DEVICE CAPABLE OF GRAY SCALE EXPANSION

(71) Applicant: Samsung Display Co., Ltd., Yongin-si, Gyeonggi-do (KR)

(72) Inventors: Kang-min Kim, Hwaseong-si (KR); Nam-gon Choi, Yongin-si (KR); Namheon Kim, Seongnam-si (KR); Joohwan Park, Seoul (KR); Jang-mi Lee, Busan (KR); Junghwan Yi, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/059,335

(22) Filed: Aug. 9, 2018

(65) Prior Publication Data

US 2019/0180702 A1 Jun. 13, 2019

(30) Foreign Application Priority Data

Dec. 11, 2017 (KR) ..... 10-2017-0169660

(51) Int. Cl.
*G09G 3/36* (2006.01)
*G09G 3/20* (2006.01)
(Continued)

(52) U.S. Cl.
CPC ..... *G09G 3/3607* (2013.01); *G09G 3/2003* (2013.01); *G09G 3/2007* (2013.01);
(Continued)

(58) Field of Classification Search
CPC ..... G09G 2320/0673; G09G 3/3696; G09G 3/3291; G09G 3/3607; G09G 2310/0289;
(Continued)

(56) References Cited

U.S. PATENT DOCUMENTS 8,508,617 B2 8/2013 Jia et al.
9,190,014 B2 11/2015 Messmer et al.
(Continued)

FOREIGN PATENT DOCUMENTS

KR 10-1503064 B1 3/2015
KR 10-2017-0088461 A 8/2017
KR 10-1765798 B1 8/2017

OTHER PUBLICATIONS

Woo, Jong-Kwan et al.; "High-Speed 10-bit LCD Column Driver with a Split DAC and a Class-AB Output Buffer"; IEEE Transactions on Consumer Electronics; vol. 55; No. 3; Aug. 2009; pp. 1431-1438.

*Primary Examiner* — Kent W Chang
*Assistant Examiner* — Scott Au
(74) *Attorney, Agent, or Firm* — Lewis Rosa Rothgerber Christie LLP

(57) ABSTRACT

A display device includes: a data driver for driving a plurality of data lines; a voltage generator for generating at least one driving voltage to be provided to the data driver; and a driving controller for providing a second image signal and a reference gamma selection signal to the data driver in response to a first image signal and a control signal received from the outside, wherein the driving controller outputs a voltage control signal for changing a voltage level of the at least one driving voltage, and the reference gamma selection signal, based on metadata included in the first image signal, and the data driver receives the reference gamma selection signal and the at least one driving voltage to provide, to the plurality of data lines, data voltage signals corresponding to the second image signal.

10 Claims, 11 Drawing Sheets

(51) Int. Cl.
*G09G 3/3258* (2016.01)
*G09G 3/3233* (2016.01)

(52) U.S. Cl.
CPC ..... *G09G 3/3233* (2013.01); *G09G 3/3258* (2013.01); *G09G 3/3614* (2013.01); *G09G 2310/0286* (2013.01); *G09G 2310/08* (2013.01); *G09G 2320/0242* (2013.01); *G09G 2320/0276* (2013.01)

(58) Field of Classification Search
CPC ..... G09G 2320/0233; G09G 2330/028; G09G 2360/16; G09G 3/2003; G09G 2320/0626; G09G 2320/0666; G09G 5/10
See application file for complete search history.

(56) References Cited

U.S. PATENT DOCUMENTS

| | | | | |
|---|---|---|---|---|
| 9,324,164 | B2 | 4/2016 | Kikuchi | |
| 9,635,377 | B2 | 4/2017 | Kim et al. | |
| 2008/0238951 | A1* | 10/2008 | Kai | G09G 3/20 345/690 |
| 2014/0049528 | A1* | 2/2014 | Koo | G09G 5/20 345/208 |
| 2015/0071615 | A1 | 3/2015 | Messmer | |
| 2016/0049127 | A1* | 2/2016 | Park | G09G 3/3688 345/213 |
| 2016/0104408 | A1* | 4/2016 | Kim | G09G 3/36 345/690 |
| 2017/0061906 | A1* | 3/2017 | Lee | G09G 3/3607 |
| 2019/0265552 | A1* | 8/2019 | Shiomi | H04N 1/407 |

* cited by examiner

DISPLAY DEVICE CAPABLE OF GRAY SCALE EXPANSION

CROSS-REFERENCE TO RELATED APPLICATION

This application claims priority to and the benefit of Korean Patent Application No. 10-2017-0169660, filed on Dec. 11, 2017, the content of which is hereby incorporated by reference in its entirety.

BACKGROUND

The present disclosure herein relates to a display device, and more particularly, to a display device capable of gray scale expansion.

Humans are known to be able to recognize a wide luminance dynamic range of about $10^{-4}$ to $10^{9}$ nit (cd/m$^2$) in a natural environment, and there is a growing interest in high dynamic range (HDR) technologies that take such a cognitive characteristic into account.

However, a luminance dynamic range that an existing display device can display is considerably narrower than that of HDR image content. For example, a peak luminance specification of HDR images is currently 10,000 nit, but peak luminance that a current display device is capable of displaying is about 1,000 nit.

Accordingly, in order to display HDR image content having a wider luminance range than a display device can display, a display device should utilize an image processing algorithm for converting the HDR image content in accordance with a narrow luminance range of the display device, that is, a gamma characteristic.

Meanwhile, a data driver converts a digital image signal into analog gray scale voltages so as to drive data lines. The range of gray scale voltages that can be displayed is limited by the limitation of the number of bits of a digital image signal processed in the data driver.

SUMMARY

The present disclosure provides a display device capable of gray scale expansion.

An embodiment of the inventive concept provides a display device including: a display panel having a plurality of pixels respectively connected to a plurality of gate lines and a plurality of data lines; a gate driver to drive the plurality of gate lines; a data driver to drive the plurality of data lines; a voltage generator to generate at least one driving voltage to be provided to the data driver; and a driving controller to provide a second image signal and a reference gamma selection signal to the data driver, and to control the gate driver, in response to a first image signal and a control signal. The driving controller may output a voltage control signal for changing a voltage level of the at least one driving voltage, and the reference gamma selection signal, based on metadata included in the first image signal. The data driver may receive the reference gamma selection signal and the at least one driving voltage to provide data voltage signals corresponding to the second image signal to the plurality of data lines.

In an embodiment, the driving controller may include: a metadata analysis circuit to analyze the metadata to obtain a maximum luminance signal and a minimum luminance signal; a bit expansion circuit to convert the first image signal into an expanded image signal between a maximum gray scale corresponding to the maximum luminance signal and a minimum gray scale corresponding to the minimum luminance signal; and a gamma correction circuit to convert the expanded image signal into the second image signal.

In an embodiment, the gamma correction circuit may output the voltage control signal and the reference gamma selection signal in response to the maximum luminance signal and the minimum luminance signal.

In an embodiment, the voltage generator may generate a first driving voltage and a second driving voltage in response to the voltage control signal.

In an embodiment, the second driving voltage may have a lower voltage level than the first driving voltage.

In an embodiment, a voltage level of the first driving voltage may be determined depending on the maximum luminance signal, and a voltage level of the second driving voltage may be determined depending on the minimum luminance signal.

In an embodiment, the data driver may include: a resistor string to generate a plurality of gamma voltages between the first driving voltage and the second driving voltage; a reference voltage selection circuit to select some of the plurality of gamma voltages in response to the reference gamma selection signal, and to output the selected gamma voltages as a plurality of reference gamma voltages; a second voltage generator to generate a plurality of voltages based on the plurality of reference gamma voltages; and a decoder to output voltages, of the plurality of voltages, corresponding to the second image signal as gray scale voltages. The gray scale voltages may be respectively provided to the plurality of data lines as the data voltage signals.

In an embodiment, the reference voltage selection circuit may include a plurality of selectors each of which receives the plurality of gamma voltages, and outputs one of the plurality of gamma voltages as a reference gamma voltage in response to the reference gamma selection signal.

In an embodiment, the resistor string may include a plurality of resistors sequentially connected in series between the first driving voltage and the second driving voltage, and output voltages of connecting nodes between the plurality of resistors as the plurality of gamma voltages.

In an embodiment, the data driver may include: a shift register to output latch clock signals in synchronization with a clock signal; a latch circuit to latch the second image signal in synchronization with the latch clock signals; a digital-to-analog converter to receive the reference gamma selection signal and the at least one driving voltage, and to convert the second image signal outputted from the latch circuit into gray scale voltages; and an output buffer to convert the gray scale voltages into the data voltage signals, and to output the data voltage signals to the data lines.

In an embodiment, the metadata may be included in a vertical blanking interval of the first image signal.

An embodiment of the inventive concept provides a display device including: a display panel having a plurality of pixels respectively connected to a plurality of gate lines and a plurality of data lines; a gate driver to drive the plurality of gate lines; a data driver to drive the plurality of data lines; a voltage generator to generate at least one driving voltage and a plurality of reference gamma voltages to be provided to the data driver; and a driving controller to provide a second image signal to the data driver, and to control the gate driver, in response to a first image signal, a control signal and metadata. The driving controller may output a voltage control signal for changing voltage levels of the at least one driving voltage and the plurality of reference gamma voltages based on luminance information included in the metadata. The data driver may receive the plurality of reference gamma voltages and the at least one driving voltage to provide data voltage signals corresponding to the second image signal to the plurality of data lines.

In an embodiment, the driving controller may include: a metadata analysis circuit to analyze the metadata to obtain a maximum luminance signal and a minimum luminance signal; a bit expansion circuit to convert the first image signal into an expanded image signal between a maximum gray scale corresponding to the maximum luminance signal and a minimum gray scale corresponding to the minimum luminance signal; and a gamma correction circuit to convert the expanded image signal into the second image signal.

In an embodiment, the gamma correction circuit may output the voltage control signal in response to the maximum luminance signal and the minimum luminance signal.

In an embodiment, the voltage generator may generate a first driving voltage and a second driving voltage in response to the voltage control signal.

In an embodiment, the second driving voltage may have a lower voltage level than the first driving voltage. The plurality of reference gamma voltages may have voltage levels different from each other between the first driving voltage and the second driving voltage.

In an embodiment, the data driver may include: a resistor string to generate a plurality of voltages between the first driving voltage and the second driving voltage based on the plurality of reference gamma voltages; and a decoder to output voltages, of the plurality of voltages, corresponding to the second image signal as gray scale voltages. The gray scale voltages may be respectively provided to the plurality of data lines as the data voltage signals.

In an embodiment, the resistor string may include a plurality of resistors sequentially connected in series between the first driving voltage and the second driving voltage, and output voltages of connecting nodes between the plurality of resistors as the plurality of voltages.

In an embodiment, the data driver may include: a shift register to output latch clock signals in synchronization with a clock signal; a latch circuit to latch the second image signal in synchronization with the latch clock signals; a digital-to-analog converter to receive the at least one driving voltage and the plurality of reference gamma voltages, and to convert the second image signal outputted from the latch circuit into gray scale voltages; and an output buffer to convert the gray scale voltages into the data voltage signals, and to output the data voltage signals to the data lines.

In an embodiment, the metadata may be included in a vertical blanking interval of the first image signal.

BRIEF DESCRIPTION OF THE DRAWINGS

The accompanying drawings are included to provide a further understanding of the inventive concept, and are incorporated in and constitute a part of the present application. The drawings illustrate exemplary embodiments according to the inventive concept and, together with the description, serve to describe principles of the inventive concept.

DETAILED DESCRIPTION

Hereinafter, embodiments of the inventive concept are described in more detail with reference to the accompanying drawings.

Figure 1:
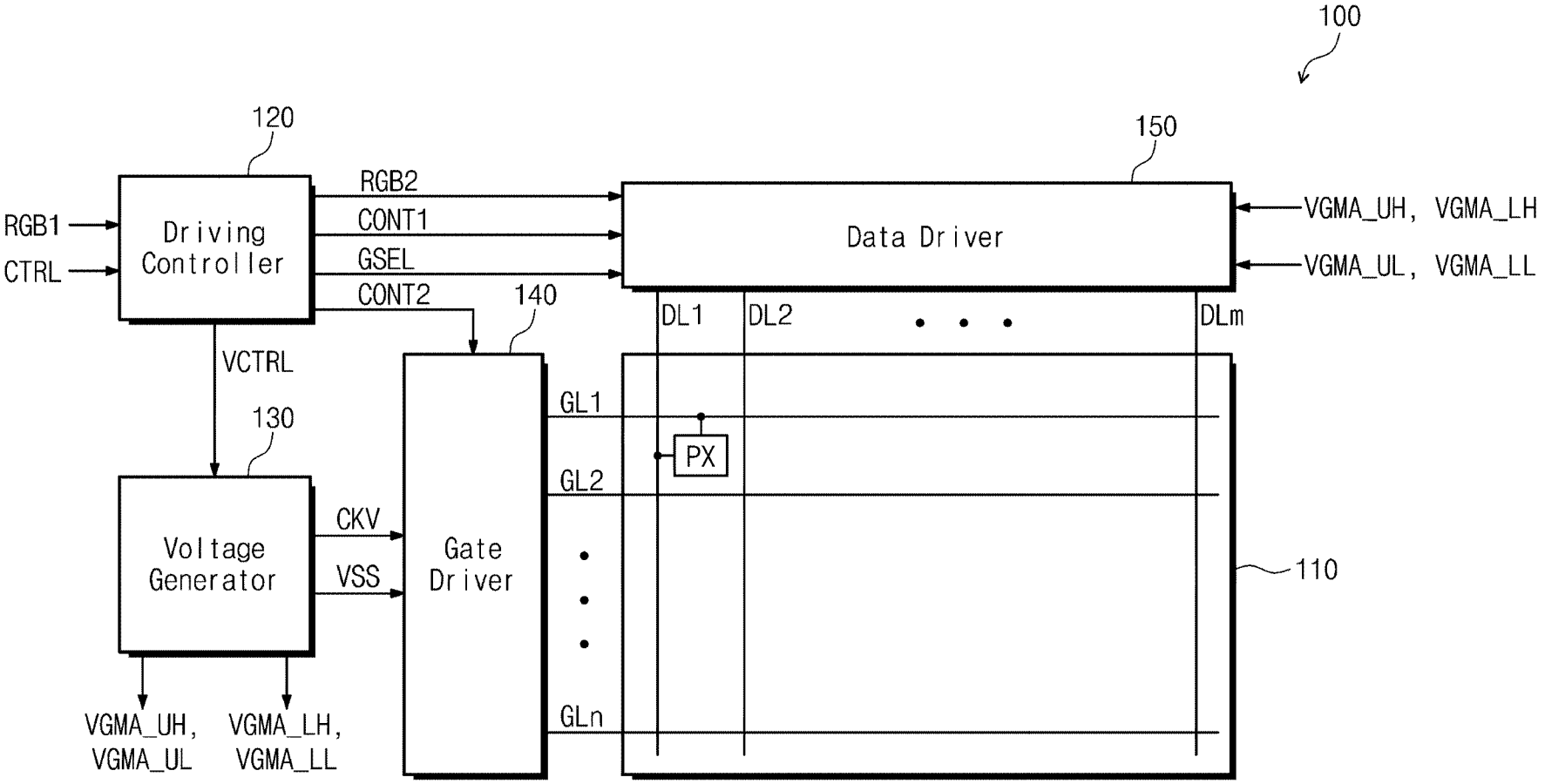
FIG. 1 is a block diagram illustrating a configuration of a display device according to an embodiment of the inventive concept.
Figure 2:
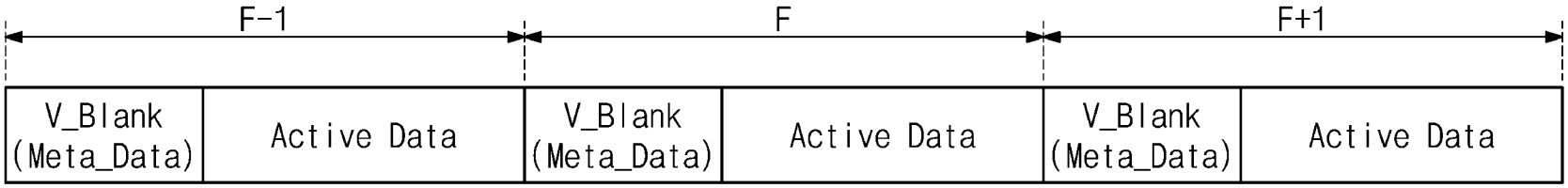
FIG. 2 illustrates an example of a first image signal that the display device receives.

FIG. 1 is a block diagram illustrating a configuration of a display device according to an embodiment of the inventive concept. FIG. 2 illustrates an example of a first image signal that the display device receives.

Referring to FIG. 1, a display device 100 includes a display panel 110, a driving controller 120, a voltage generator 130, a gate driver 140, and a data driver 150.

The display panel 110 includes a plurality of data lines DL1 to DLm, a plurality of gate lines GL1 to GLn arranged crossing the data lines DL1 to DLm, and a plurality of pixels PX arranged at crossing areas (or crossing regions) thereof. The plurality of data lines DL1 to DLm and the plurality of gate lines GL1 to GLn are insulated from each other.

Each of the pixels PX may include, although not illustrated in a figure, a switching transistor connected to a corresponding data line and a corresponding gate line, and a liquid crystal capacitor and a storage capacitor connected thereto.

In the case that the display device 100 is an organic light-emitting display device, each of the pixels PX may include an organic light-emitting element and switching transistors for operating the organic light-emitting element.

A graphic processor (not illustrated) connected to the display device 100 provides, to the driving controller 120, a first image signal RGB1 obtained by encoding metadata and a full high definition (FHD) image or an ultra-high definition (UHD) image having a high dynamic range (HDR).

As illustrated in FIG. 2, the first image signal RGB1 includes a blanking interval and an active data interval for each frame. The metadata is included in the blanking interval of the first image signal RGB1, and includes HDR information about a corresponding frame. The metadata may include minimum and maximum luminance information of a corresponding frame, but is not limited thereto and may further include information such as backlight peak luminance, tone mapping, and/or color temperature.

In this embodiment, the metadata is included in the blanking interval of the first image signal RGB1 every frame, but metadata having the same value as in a previous frame may not be transmitted in order to reduce or minimize the increase of a bit rate (e.g., reduce or minimize the bit rate of the image signal). In another embodiment, metadata may be stored for each piece of content.

The driving controller 120 receives, from the outside (e.g., outside the display device 100), the first image signal RGB1 and control signals CTRL for controlling a display thereof such as a vertical synchronization signal, a horizontal synchronization signal, a main clock signal and a data enable signal. The driving controller 120 provides a second image signal RGB2 obtained by processing the first image signal RGB1 in accordance with an operating condition of the display panel 110, and a first control signal CONT1 to the data driver 150, and provides a second control signal CONT2 to the gate driver 140, based on the control signals CTRL. The first control signal CONT1 may include a clock signal CLK, a polarity inversion signal POL, and a line latch signal LOAD, and the second control signal CONT2 may include a vertical synchronization start signal, an output enable signal, a gate pulse signal, and the like. In this embodiment, the driving controller 120 converts the first image signal RGB1 into the second image signal RGB2 based on the metadata included in the first image signal RGB1, and outputs a voltage control signal VCTRL.

The voltage generator 130 generates a plurality of voltages and clock signals for operation of the display panel 110. In this embodiment, the voltage generator 130 provides a gate clock signal CKV and a ground voltage VSS to the gate driver 140. In addition, the voltage generator 130 further generates a first driving voltage VGMA_UH, a second driving voltage VGMA_UL, a third driving voltage VGMA_LH, and a fourth driving voltage VGMA_LL for operation of the data driver 150.

The voltage generator 130 sets voltage levels of the first driving voltage VGMA_UH, the second driving voltage VGMA_UL, the third driving voltage VGMA_LH, and the fourth driving voltage VGMA_LL, in response to the voltage control signal VCTRL from the driving controller 120.

The gate driver 140 drives the gate lines GL1 to GLn in response to the second control signal CONT2 from the driving controller 120, and the gate clock signal CKV and the ground voltage VSS from the voltage generator 130. The gate driver 140 may include a gate driving integrated circuit (IC). The gate driver 140 may also be implemented, in addition to the gate driving IC, by an amorphous silicon gate (ASG) using an amorphous silicon thin film transistor (a-Si TFT), and a circuit using an oxide semiconductor, a crystalline semiconductor, a polycrystalline semiconductor, and/or the like. The gate driver 140 may be formed concurrently (e.g., simultaneously) with pixels PX11 to PXnm through a thin film process. In this case, the gate driver 140 may be disposed in a set (e.g., predetermined) area (for example, a non-display area) on one side of the display panel 110.

The data driver 150 outputs data voltage signals D1 to Dm for driving the data lines DL1 to DLm, by using the first driving voltage VGMA_UH, the second driving voltage VGMA_UL, the third driving voltage VGMA_LH, and the fourth driving voltage VGMA_LL, in response to the second image signal RGB2, the first control signal CONT1, and a reference gamma selection signal GSEL from the driving controller 120.

While the gate driver 140 drives one gate line by using a gate-on voltage of a set (e.g., predetermined) level, switching transistors in one row of the pixels PX connected thereto become turned on. At this time, the data driver 150 provides, to the data lines DL1 to DLm, gray scale voltages corresponding to the second image signal RGB2. The gray scale voltages provided to the data lines DL1 to DLm are applied to corresponding liquid crystal capacitors and storage capacitors through the turned-on switching transistors. Here, in order to prevent degradation of the liquid crystal capacitors, the data driver 150 may alternate the gray scale voltages corresponding to the second image signal RGB2 between positive (+) and negative (−) polarities every frame. The first driving voltage VGMA_UH and the second driving voltage VGMA_UL are voltages used for positive polarity drive, and the third driving voltage VGMA_LH and the fourth driving voltage VGMA_LL are voltages used for negative polarity drive.

The driving controller 120 provides, to the data driver 150, the reference gamma selection signal GSEL for selecting a plurality of reference voltages between the first driving voltage VGMA_UH and the second driving voltage VGMA_UL, and a plurality of reference voltages between the third driving voltage VGMA_LH and the fourth driving voltage VGMA_LL.

Figure 3:
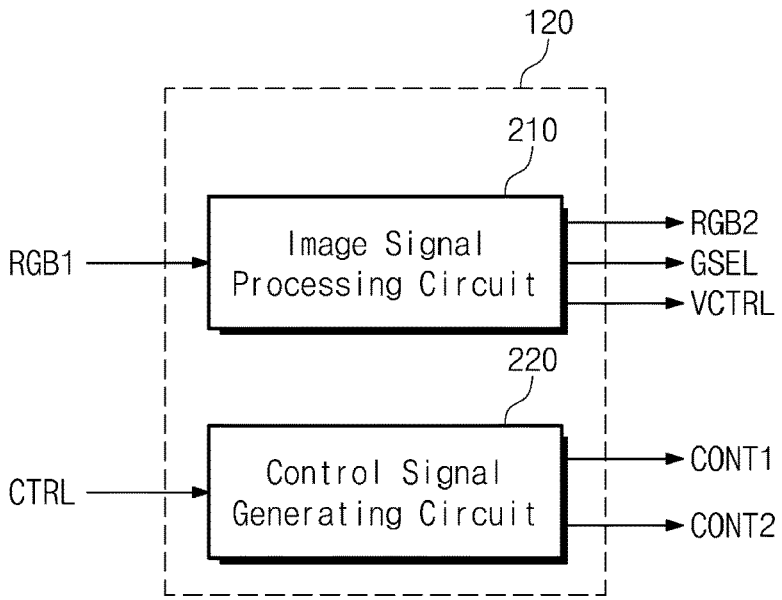
FIG. 3 is a block diagram illustrating a configuration of a driving controller according to an embodiment of the inventive concept.

FIG. 3 is a block diagram illustrating a configuration of the driving controller according to an embodiment of the inventive concept.

Referring to FIG. 3, the driving controller 120 includes an image signal processing circuit 210 and a control signal generating circuit 220.

The image signal processing circuit 210 converts the first image signal RGB1 into the second image signal RGB2. Additionally, the image signal processing circuit 210 outputs the voltage control signal VCTRL for changing a voltage level of at least one driving voltage, and the reference gamma selection signal GSEL, based on the metadata included in the first image signal RGB1.

The control signal generating circuit 220 outputs the first control signal CONT1 and the second control signal CONT2 based on the control signals CTRL received from the outside. The first control signal CONT1 may include a horizontal synchronization start signal, a clock signal and a line latch signal, and the second control signal CONT2 may include a vertical synchronization start signal, an output enable signal and a gate pulse signal.

Figure 4:
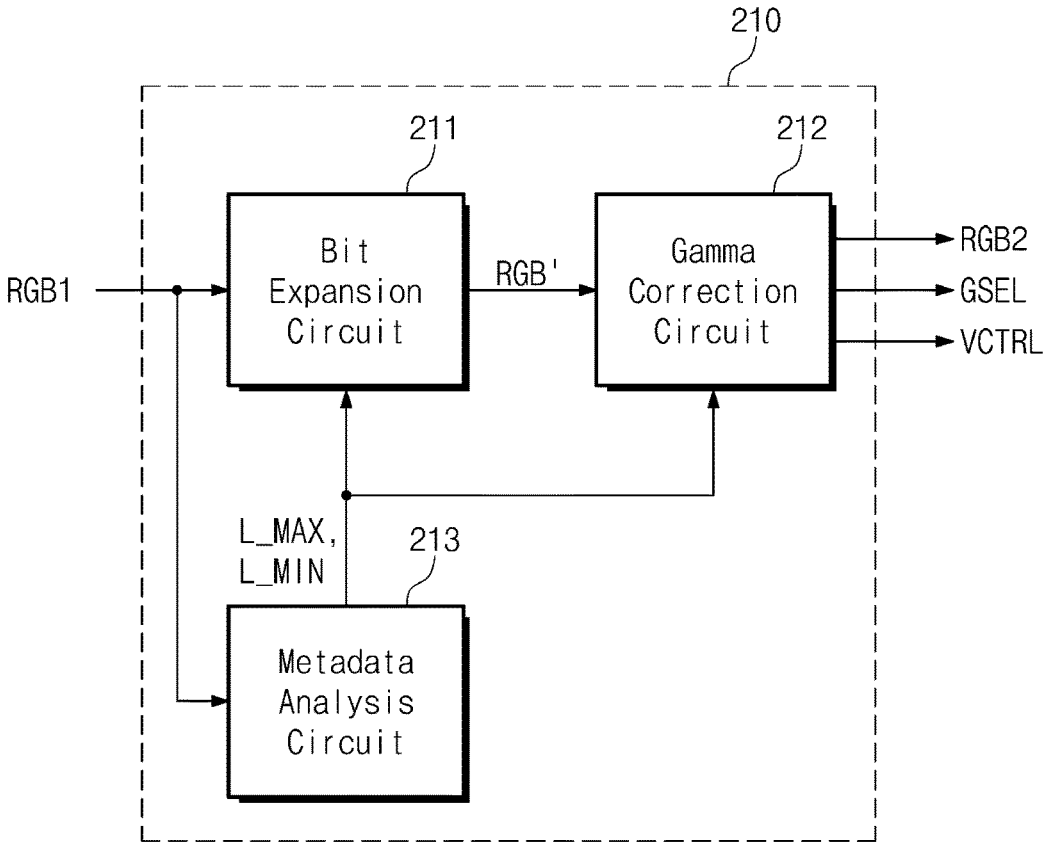
FIG. 4 is a block diagram illustrating a configuration of an image signal processing circuit according to an embodiment of the inventive concept.

FIG. 4 is a block diagram illustrating a configuration of the image signal processing circuit according to an embodiment of the inventive concept.

Referring to FIG. 4, the image signal processing circuit 210 includes a bit expansion circuit 211, a gamma correction circuit 212 and a metadata analysis circuit 213. The metadata analysis circuit 213 detects the metadata included in the first image signal RGB1, and analyzes the detected metadata to output a maximum luminance signal L_MAX and a minimum luminance signal L_MIN.

The bit expansion circuit 211 converts the first image signal RGB1 into an expanded image signal RGB' in response to the maximum luminance signal L_MAX and the minimum luminance signal L_MIN.

The gamma correction circuit 212 converts the expanded image signal RGB' into the second image signal RGB2 in response to the maximum luminance signal L_MAX and the minimum luminance signal L_MIN. In addition, the gamma correction circuit 212 outputs the voltage control signal VCTRL and the reference gamma selection signal GSEL in response to the maximum luminance signal L_MAX and the minimum luminance signal L_MIN.

Figure 5:
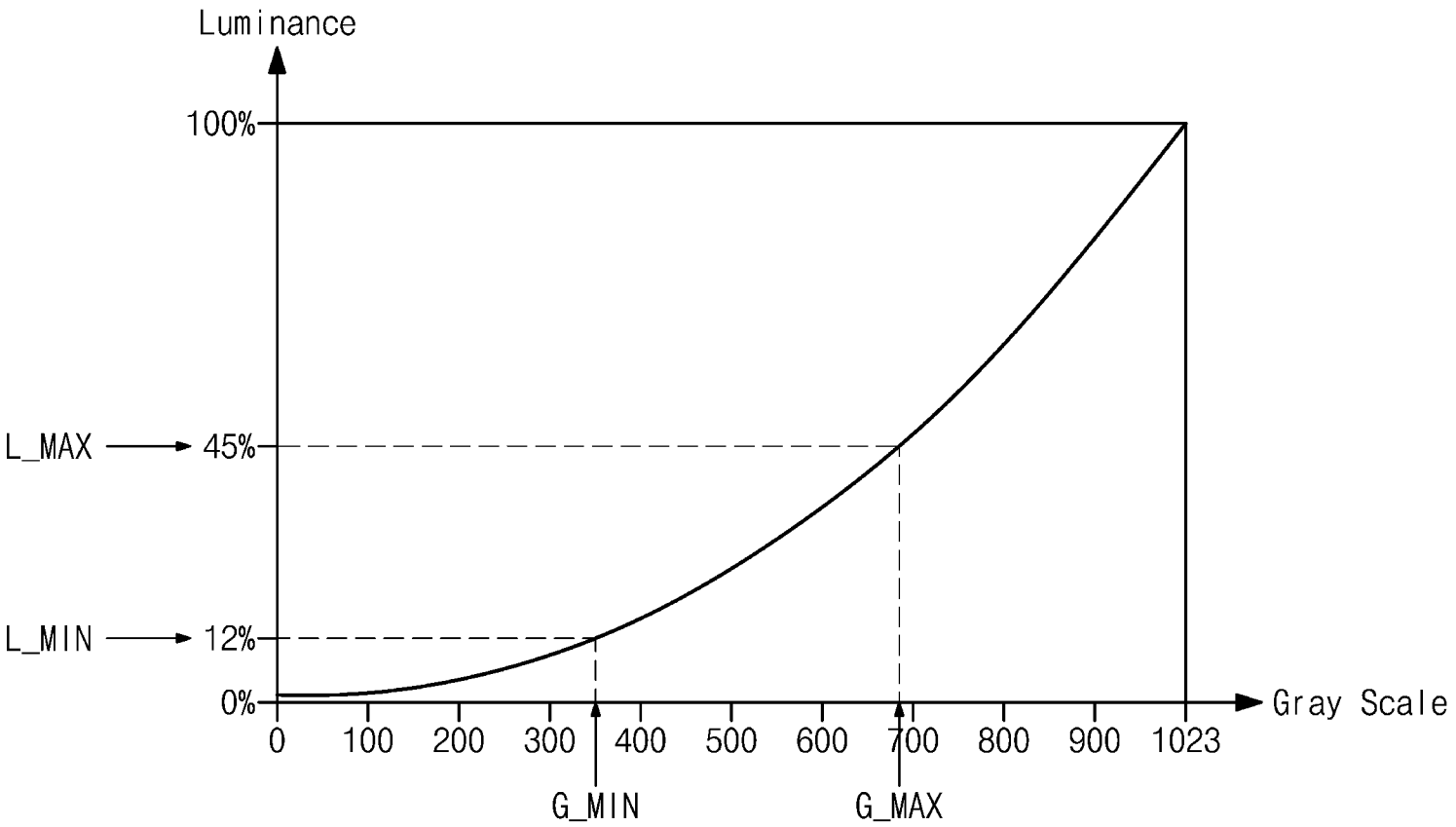
FIG. 5 is a graph for describing an operation of the image signal processing circuit according to an embodiment of the inventive concept.

FIG. 5 is a graph for describing an operation of the image signal processing circuit according to an embodiment of the inventive concept.

Referring to FIGS. 4 and 5, when the bit width of the first image signal RGB1 is 10 bits, the first image signal RGB1 may display gray scale levels (i.e., gray levels) 0 to 1023. The first image signal RGB1 may display gray scale levels (i.e., gray levels) 0 to 1023 in one frame, but includes some of the 1024 gray scale levels (i.e., gray levels) under normal operating conditions. For example, a first image signal RGB1 for displaying an image of a sunny beach may include many high-luminance gray scale levels (e.g., gray scale levels of 800 or higher), and a first image signal RGB1 for displaying an image of a dark cave may include many low-luminance gray scale levels (e.g., gray scale levels of 400 or lower).

FIG. 5 illustrates, by way of example, a case in which a normalized maximum luminance is 45% and a minimum is 12% for the first image signal RGB1. According to the example illustrated in FIG. 5, the maximum luminance signal L_MAX of the metadata included in the first image signal RGB1 may represent 45%, and the minimum luminance signal L_MIN may represent 12%.

The bit expansion circuit 211 illustrated in FIG. 4 converts the first image signal RGB1 into an expanded image signal RGB' between a maximum gray scale level (i.e., a maximum gray level) G_MAX and a minimum gray scale level (i.e., a minimum gray level) G_MIN in response to the maximum luminance signal L_MAX and the minimum luminance signal L_MIN. For example, the maximum gray scale level G_MAX may be 1023 and the minimum gray scale level G_MIN may be 0.

As illustrated in FIG. 5, when a gray scale level corresponding to the minimum luminance signal L_MIN is 350 and a gray scale level corresponding to the maximum luminance signal L_MAX is 690, the bit expansion circuit 211 expands effective gray scale levels from 350 to 690 of the first image signal RGB1 into gray scale levels from 0 to 1023. In this embodiment, the bit width of each of the first image signal RGB1 and the expanded image signal RGB' is 10 bits.

The gamma correction circuit 212 performs gamma correction on the expanded image signal RGB', and converts the expanded image signal RGB' into the second image signal RGB2 in response to the maximum luminance signal L_MAX and the minimum luminance signal L_MIN. The gamma correction circuit 212 may perform gamma correction corresponding to any one gamma curve suitable for the display device 100 among various gamma curves such as gamma of 2.2, gamma of 2.3, and gamma of 2.4.

Additionally, a quantization error that may be caused by the gamma correction circuit 212 may be compensated for by changing voltage levels of the first to fourth driving voltages VGMA_UH, VGMA_UL, VGMA_LH, and VGMA_LL and reference gamma voltages utilized for an operation of the data driver 150. The voltage levels of the first and fourth driving voltages VGMA_UH and VGMA_LL may be determined depending on the maximum luminance signal L_MAX, and the voltage levels of the second and third driving voltages VGMA_UL and VGMA_LH may be determined depending on the minimum luminance signal L_MIN.

Figure 6:
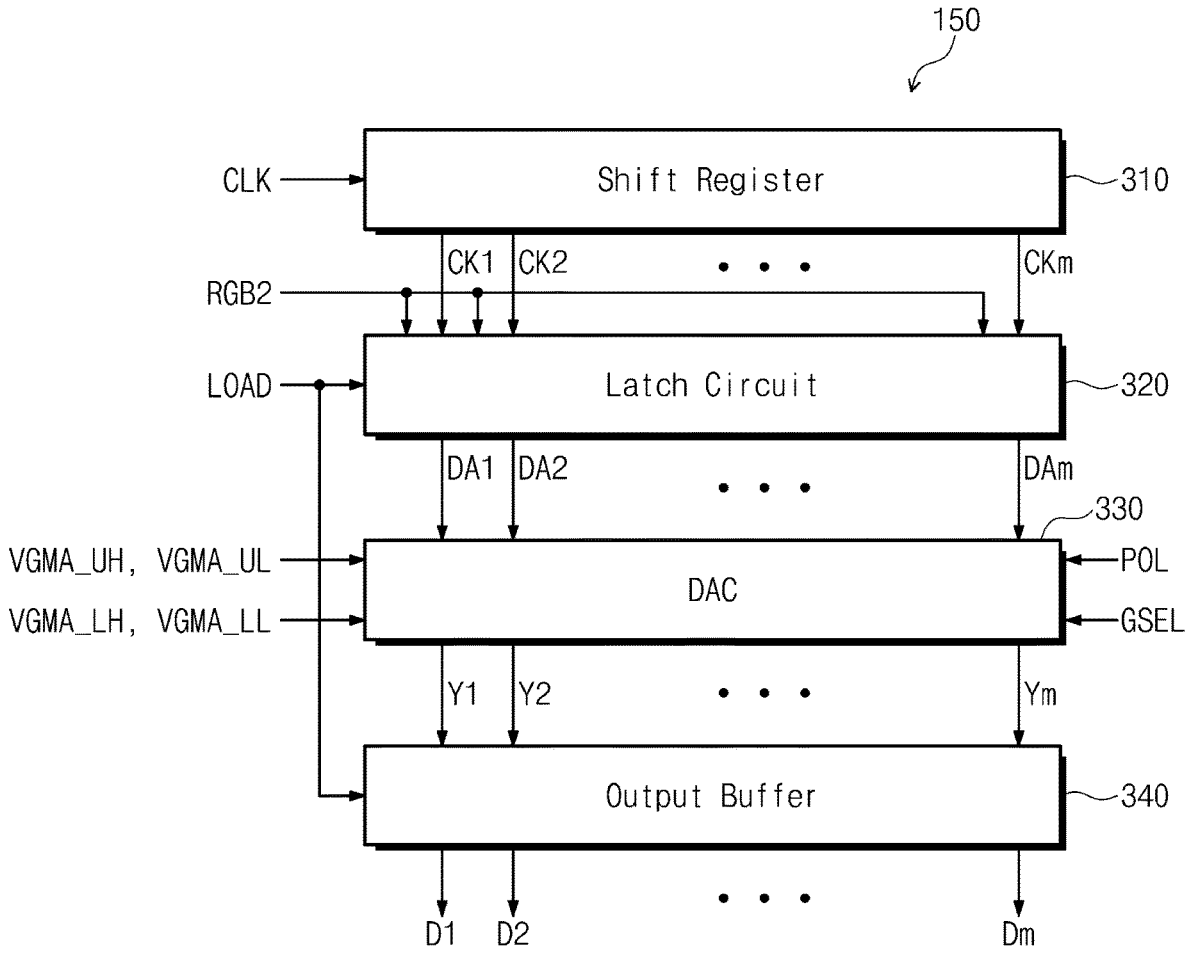
FIG. 6 is a block diagram illustrating a configuration of a data driver according to an embodiment of the inventive concept.

FIG. 6 is a block diagram illustrating a configuration of the data driver according to an embodiment of the inventive concept.

Referring to FIG. 6, the data driver 150 includes a shift register 310, a latch circuit 320, a digital-to-analog converter 330, and an output buffer 340. In FIG. 6, the clock signal CLK, the line latch signal LOAD and the polarity inversion signal POL are signals included in the first control signal CONT1 provided from the driving controller 120 illustrated in FIG. 1.

The shift register 310 sequentially activates latch clock signals CK1 to CKm in synchronization with the clock signal CLK. The latch circuit 320 latches the second image signal RGB2 in synchronization with the latch clock signals CK1 to CKm from the shift register 310, and provides latch data signals DA1 to DAm concurrently (e.g., simultaneously) to the digital-to-analog converter 330 in response to the line latch signal LOAD.

The digital-to-analog converter 330 receives the polarity inversion signal POL and the reference gamma selection signal GSEL from the driving controller 120 illustrated in FIG. 1, and receives the first to fourth driving voltages VGMA_UH, VGMA_UL, VGMA_LH, and VGMA_LL from the voltage generator 130 illustrated in FIG. 1. The digital-to-analog converter 330 outputs, to the output buffer 340, gray scale voltages Y1 to Ym corresponding to the latch data signals DA1 to DAm from the latch circuit 320. The output buffer 340 receives the gray scale voltages Y1 to Ym from the digital-to-analog converter 330, and outputs the data voltage signals D1 to Dm to the data lines DL1 to DLm in response to the line latch signal LOAD.

Figure 7:
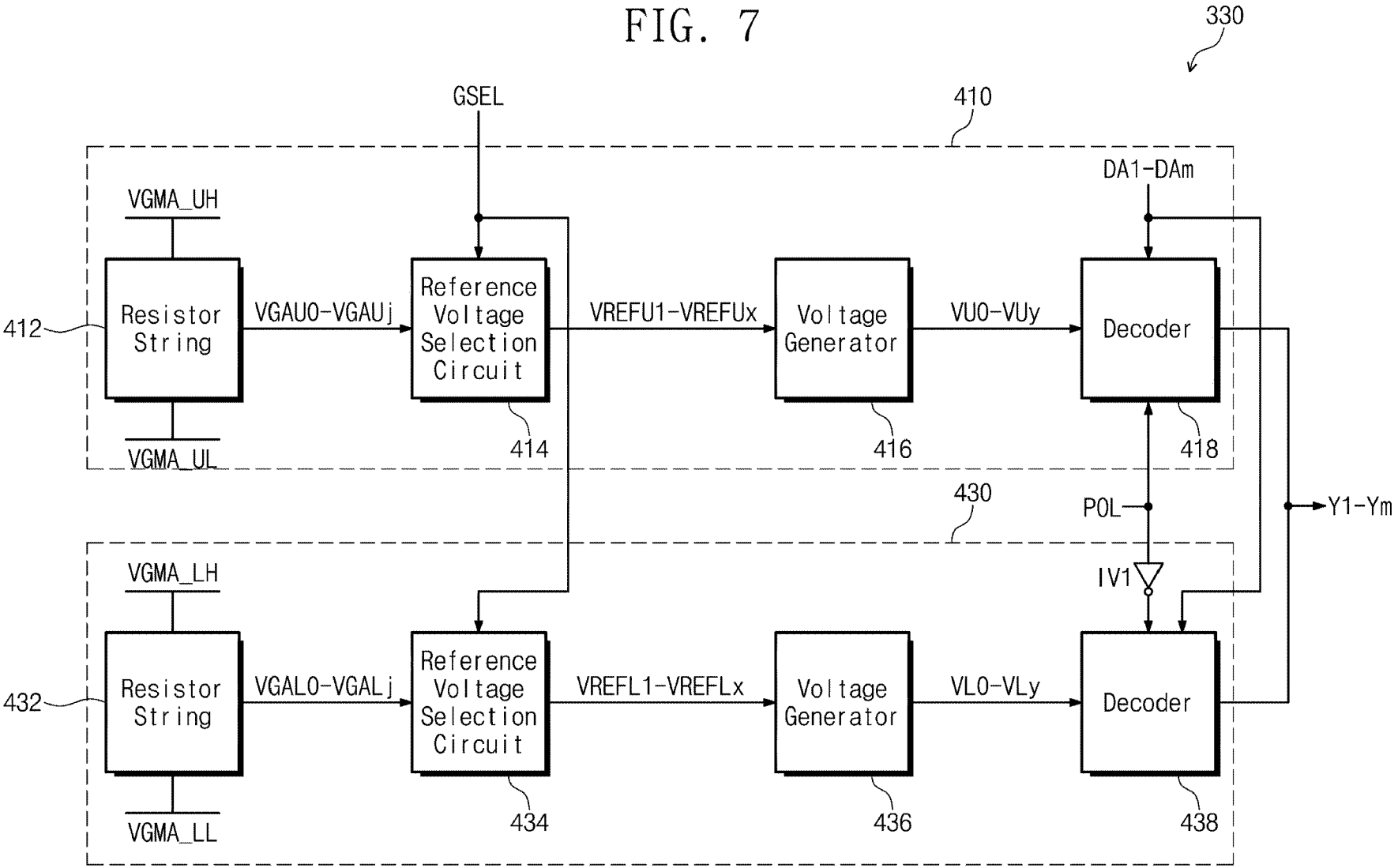
FIG. 7 is a block diagram illustrating a configuration of a digital-to-analog converter, illustrated in FIG. 6, according to an embodiment of the inventive concept.

FIG. 7 is a block diagram illustrating a configuration of the digital-to-analog converter, illustrated in FIG. 6, according to an embodiment of the inventive concept.

Referring to FIG. 7, the digital-to-analog converter 330 includes a positive converter 410 and a negative converter 430.

The positive converter 410 includes a resistor string 412, a reference voltage selection circuit 414, a voltage generator 416, and a decoder 418. The resistor string 412 receives the first driving voltage VGMA_UH and the second driving voltage VGMA_UL from the voltage generator 130 illustrated in FIG. 1, and generates a plurality of gamma voltages VGAU0 to VGAUj.

The resistor string 412 divides the first driving voltage VGMA_UH and the second driving voltage VGMA_UL so as to output the plurality of gamma voltages VGAU0 to VGAUj.

The reference voltage selection circuit 414 outputs some of the plurality of gamma voltages VGAU0 to VGAUj as a plurality of reference gamma voltages VREFU1 to VREFUx in response to the reference gamma selection signal GSEL.

The voltage generator 416 generates a plurality of voltages VU0 to VUy based on the plurality of reference gamma voltages VREFU1 to VREFUx. Here, each of j, x, and y is a positive integer.

The decoder 418 converts the latch data signals DA1 to DAm into the gray scale voltages Y1 to Ym with reference to the plurality of voltages VU0 to VUy while the polarity inversion signal POL is at a first level (for example, a high level).

The negative converter 430 includes a resistor string 432, a reference voltage selection circuit 434, a voltage generator 436, and a decoder 438.

The resistor string 432 divides the third driving voltage VGMA_LH and the fourth driving voltage VGMA_LL from the voltage generator 130 illustrated in FIG. 1 so as to generate a plurality of gamma voltages VGAL0 to VGALj.

The reference voltage selection circuit 434 outputs some of the plurality of gamma voltages VGAL0 to VGALj as a plurality of reference gamma voltages VREFL1 to VREFLx in response to the reference gamma selection signal GSEL.

The voltage generator 436 generates a plurality of voltages VL0 to VLy based on the plurality of reference gamma voltages VREFL1 to VREFLx. Here, each of j, x, and y is a positive integer.

The decoder 438 converts the latch data signals DA1 to DAm into the gray scale voltages Y1 to Ym with reference to the plurality of voltages VL0 to VLy while the polarity inversion signal POL is at a second level (for example, a low level).

Figure 8:
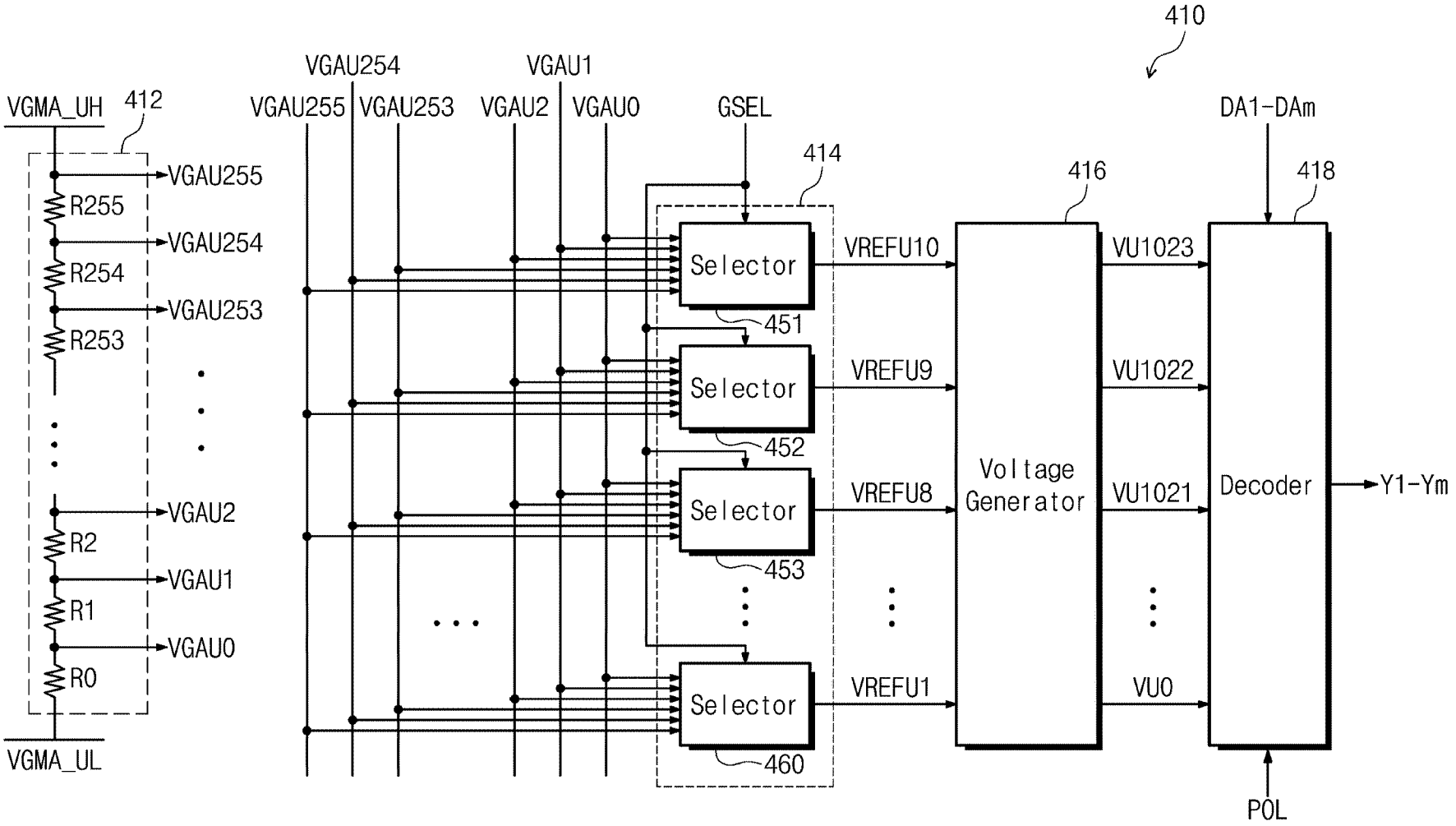
FIG. 8 illustrates a configuration of a positive converter, illustrated in FIG. 7, according to an embodiment of the inventive concept.

FIG. 8 illustrates a configuration of the positive converter, illustrated in FIG. 7, according to an embodiment of the inventive concept.

Referring to FIG. 8, the resistor string 412 receives the first driving voltage VGMA_UH and the second driving voltage VGMA_UL, and outputs the gamma voltages VGAU0 to VGAU255. The resistor string 412 includes resistors R0 to R255 sequentially connected in series between the first driving voltage VGMA_UH and the second driving voltage VGMA_UL. Voltages of connecting nodes between the resistors R0 to R255 are outputted as the gamma voltages VGAU0 to VGAU255.

The reference voltage selection circuit 414 includes selectors 451 to 460. The selectors 451 to 460 output some of the gamma voltages VGAU0 to VGAU255 as the reference gamma voltages VREFU1 to VREFU10 in response to the reference gamma selection signal GSEL.

For example, the selector 451 may output the gamma voltage VGAU248 as the reference gamma voltage VREFU10, the selector 452 may output the gamma voltage VGAU220 as the reference gamma voltage VREFU9, and the selector 460 may output the gamma voltage VGAU8 as the reference gamma voltage VREFU1.

The voltage generator 416 receives the reference gamma voltages VREFU1 to VREFU10, and generates the voltages VU0 to VU1023. The voltage generator 416 may generate the plurality of voltages by voltage division between two adjacent reference voltages. For example, the voltage generator 416 may generate the voltages VU0 to VU90 by voltage division between the reference gamma voltages VREFU1 and VREFU2, and generate the voltages VU91 to VU120 by voltage division between the reference gamma voltages VREFU2 and VREFU3. In this way, the voltage generator 416 may generate the voltages VU0 to VU1023 by using the 10 reference gamma voltages VREFU1 to VREFU10. Voltage differences between the voltages VU0 to VU1023 based on the reference gamma voltages VREFU1 to VREFU10, and the number of the voltages generated by two adjacent reference voltages may be determined according to a method set (e.g., preset) in the voltage generator 416.

The decoder 418 converts the latch data signals DA1 to DAm into the gray scale voltages Y1 to Ym with reference to the voltages VU0 to VU1023 while the polarity inversion signal POL is at a first level (for example, a high level).

In this embodiment, the resistor string 412 includes 256 resistors and outputs the 256 voltages VGAU0 to VGAU255, but the number of the resistors and the number of the output voltages may be variously changed.

In this embodiment, the selection circuit 414 outputs 10 of the voltages VGAU0 to VGAU255 as the reference gamma voltages VREFU1 to VREFU10, but the number of the reference voltages may be variously changed in a suitable manner known to those skilled in the art. As the number of the reference voltages becomes larger, distortion in a process of converting the received image signal RGB2 into the data voltage signals D1 to Dm may be reduced or minimized.

The negative converter 430 illustrated in FIG. 7 may have a circuit configuration similar to that of the positive converter 410 illustrated in FIG. 8.

Referring to FIGS. 4 to 8, the first image signal RGB1 may be converted into the expanded image signal RGB' between the maximum gray scale level (i.e., the maximum gray level) G_MAX and the minimum gray scale level (i.e., the minimum gray level) G_MIN by the bit expansion circuit 211, and then converted into the second image signal RGB2 which has been subjected to gamma correction by the gamma correction circuit 212. Accordingly, an effect of increasing the number of displayable gray scale levels (i.e., gray levels) may be obtained by converting the first image signal RGB1 into the second image signal RGB2.

When voltage levels of the first to fourth driving voltages VGMA_UH, VGMA_UL, VGMA_LH, and VGMA_LL are changed depending on the maximum luminance signal L_MAX and the minimum luminance signal L_MIN, voltage levels of the plurality of gamma voltages VGAU0 to VGAU255, and VGAL0 to VGAL255 outputted from the resistor strings 412 and 432 may be changed.

Additionally, as the reference gamma selection signal GSEL is changed depending on the maximum luminance signal L_MAX and the minimum luminance signal L_MIN, voltage levels of the reference gamma voltages VREFU1 to VREFU10, and VREFL1 to VREFL10 selected by the reference voltage selection circuits 414 and 434 may be changed.

By changing the voltage levels of the first to fourth driving voltages VGMA_UH, VGMA_UL, VGMA_LH, and VGMA_LL, and voltage levels of the reference gamma voltages VREFU1 to VREFU10, and VREFL1 to VREFL10 selected by the reference gamma selection signal GSEL, voltage levels of the gray scale voltages Y1 to Ym may be adjusted. Accordingly, luminance change of a displayed image caused by converting the first image signal RGB1 into the second image signal RGB2 may be reduced or prevented.

Figure 9:
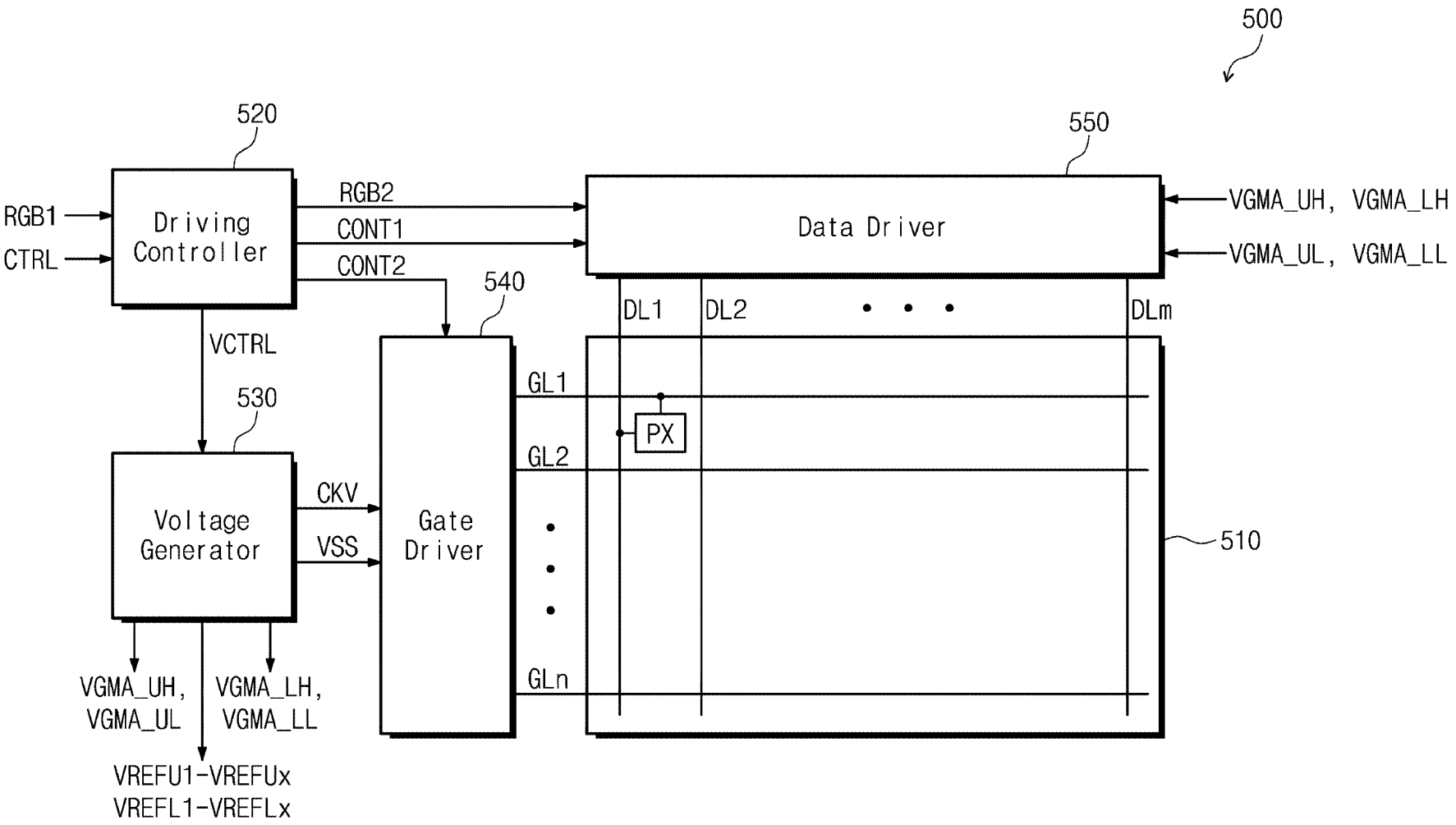
FIG. 9 is a block diagram illustrating a configuration of a display device according to another embodiment of the inventive concept.

FIG. 9 is a block diagram illustrating a configuration of a display device according to another embodiment of the inventive concept.

Referring to FIG. 9, a display device 500 includes a display panel 510, a driving controller 520, a voltage generator 530, a gate driver 540, and a data driver 550. Because the display device 500 illustrated in FIG. 9 has a configuration that is substantially similar to that of the display device 100 illustrated in FIG. 1, redundant description may be omitted.

The voltage generator 530 included in the display device 500 further generates a plurality of reference gamma voltages VREFU1 to VREFUx, and VREFL1 to VREFLx, in addition to first to fourth driving voltages VGMA_UH, VGMA_UL, VGMA_LH, and VGMA_LL in response to a voltage control signal VCTRL from the driving controller 520.

Figure 10:
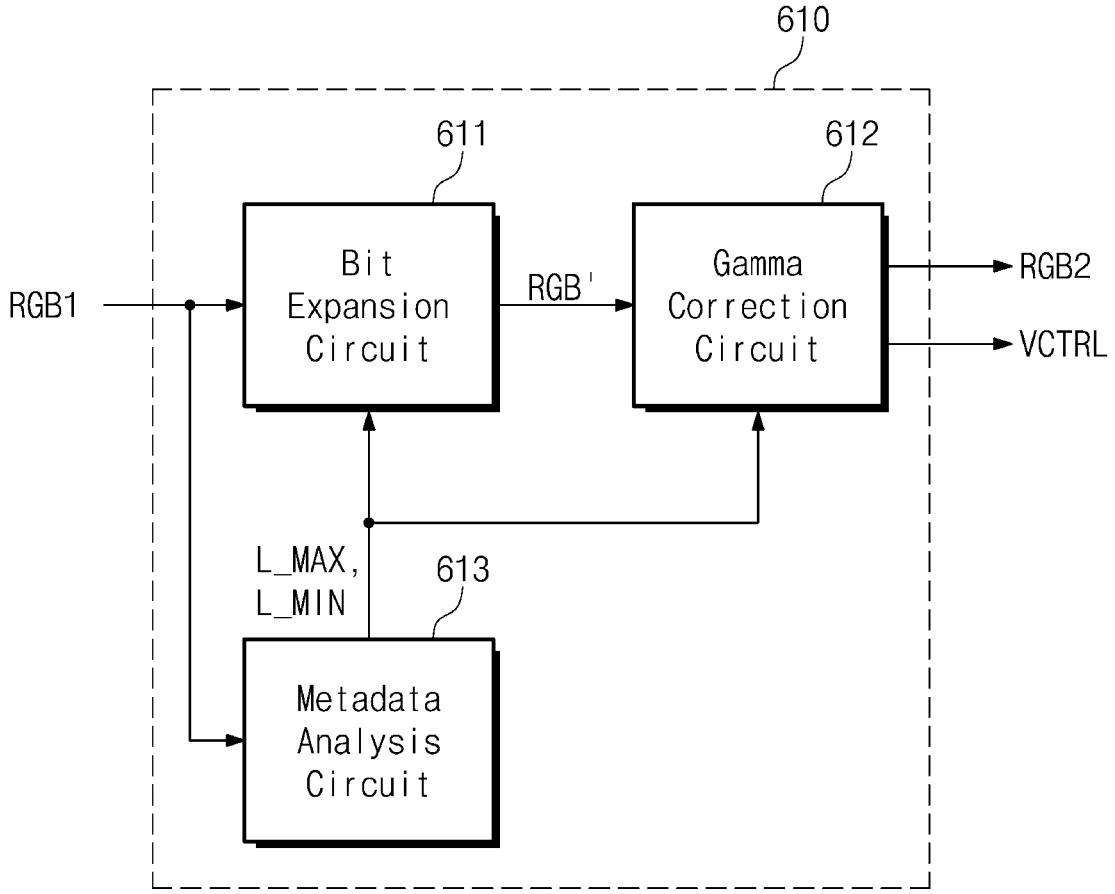
FIG. 10 is a block diagram illustrating a configuration of an image signal processing circuit in a driving controller according to another embodiment of the inventive concept.

FIG. 10 is a block diagram illustrating a configuration of an image signal processing circuit in the driving controller according to another embodiment of the inventive concept.

Referring to FIG. 10, an image signal processing circuit 610 includes a bit expansion circuit 611, a gamma correction circuit 612, and a metadata analysis circuit 613. The metadata analysis circuit 613 detects metadata included in a first image signal RGB1, and analyzes the detected metadata to output a maximum luminance signal L_MAX and a minimum luminance signal L_MIN.

The bit expansion circuit 611 converts the first image signal RGB1 into an expanded image signal RGB' in response to the maximum luminance signal L_MAX and the minimum luminance signal L_MIN.

The gamma correction circuit 612 converts the expanded image signal RGB' into a second image signal RGB2 in response to the maximum luminance signal L_MAX and the minimum luminance signal L_MIN. Additionally, the gamma correction circuit 612 outputs the voltage control signal VCTRL in response to the maximum luminance signal L_MAX and the minimum luminance signal L_MIN.

Figure 11:
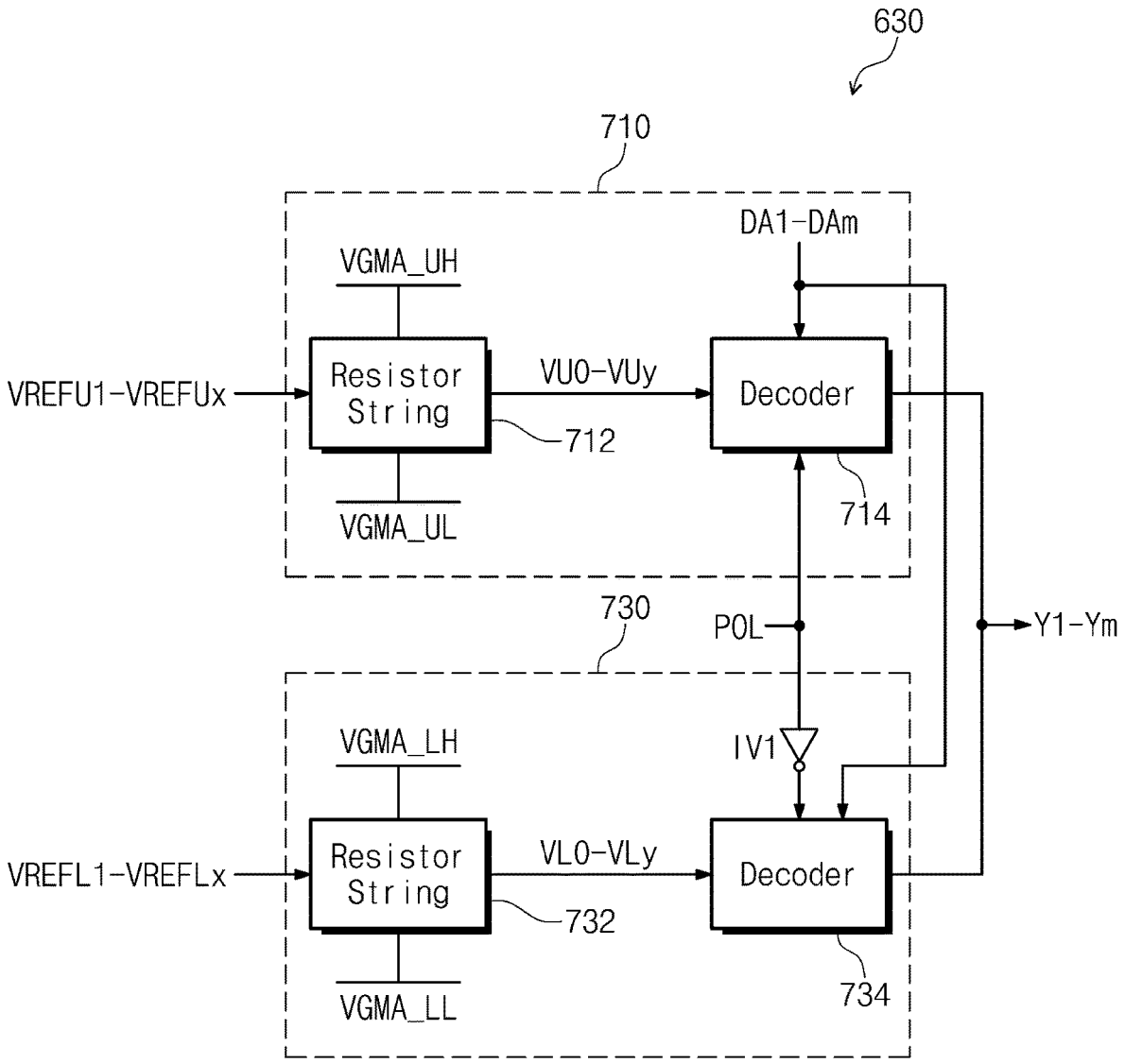
FIG. 11 is a block diagram illustrating a circuit configuration of a digital-to-analog converter in a data driver according to another embodiment of the inventive concept.

FIG. 11 is a block diagram illustrating a circuit configuration of a digital-to-analog converter in the data driver according to another embodiment of the inventive concept.

Referring to FIG. 11, a digital-to-analog converter 630 includes a positive converter 710 and a negative converter 730.

The positive converter 710 includes a resistor string 712 and a decoder 714. The resistor string 712 receives the first driving voltage VGMA_UH, the second driving voltage VGMA_UL, and the plurality of reference gamma voltages VREFU1 to VREFUx from the voltage generator 530 illustrated in FIG. 9, and generates a plurality of voltages VU0 to VUy. The decoder 714 converts latch data signals DA1 to DAm into gray scale voltages Y1 to Ym with reference to the plurality of voltages VU0 to VUy while a polarity inversion signal POL is at a first level (for example, a high level).

The negative converter 730 includes a resistor string 732 and a decoder 734. The resistor string 732 receives the third driving voltage VGMA_LH, the fourth driving voltage VGMA_LL, and the plurality of reference gamma voltages VREFL1 to VREFLx from the voltage generator 530 illustrated in FIG. 9, and generates a plurality of voltages VL0 to VLy. The decoder 734 converts the latch data signals DA1 to DAm into the gray scale voltages Y1 to Ym with reference to the plurality of voltages VL0 to VLy while the polarity inversion signal POL is at a second level (for example, a low level).

Figure 12:
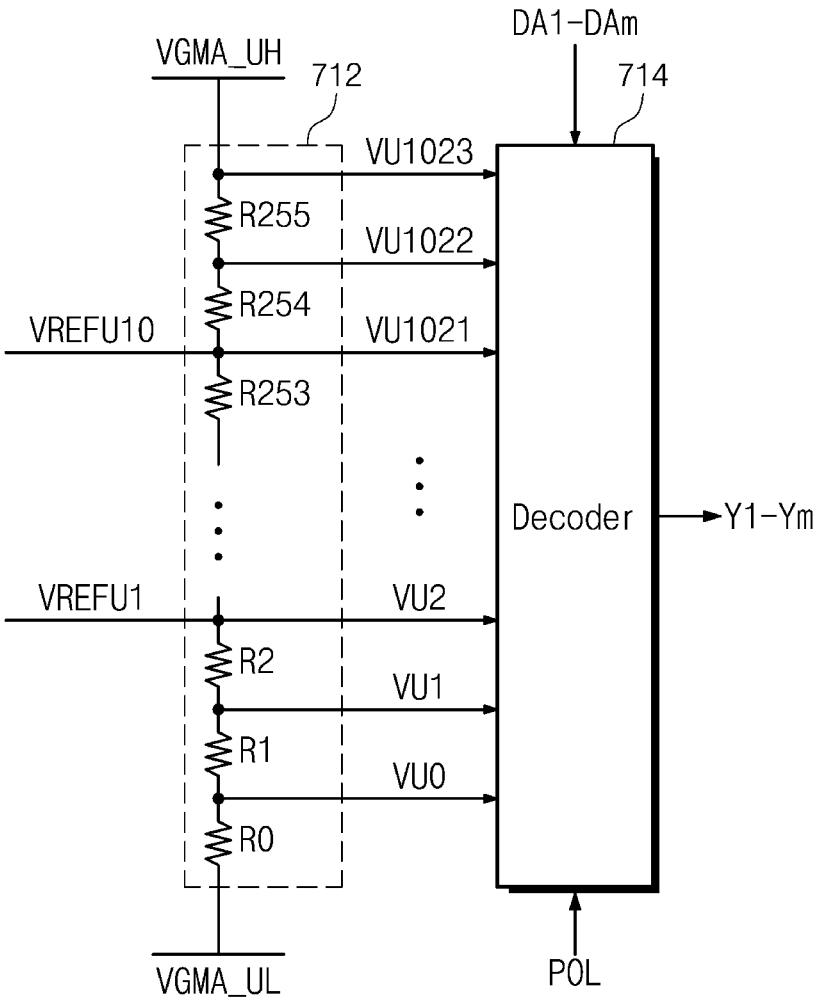
FIG. 12 illustrates a configuration of a positive converter, illustrated in FIG. 11, according to another embodiment of the inventive concept.

FIG. 12 illustrates a configuration of the positive converter, illustrated in FIG. 11, according to another embodiment of the inventive concept.

Referring to FIG. 12, the resistor string 712 receives the first driving voltage VGMA_UH, the second driving voltage VGMA_UL, and the reference gamma voltages VREFU1 to VREFU10, and generates the voltages VU0 to VU1023. Resistors R0 to R255 are sequentially connected in series between the second driving voltage VGMA_UL and the first driving voltage VGMA_UH. The reference gamma voltages VREFU1 to VREFU10 are respectively connected to set (e.g., predetermined) nodes among connecting nodes of the resistors R0 to R255.

The decoder 714 converts the latch data signals DA1 to DAm into the gray scale voltages Y1 to Ym with reference to the voltages VU0 to VU1023 while the polarity inversion signal POL is at a first level (for example, a high level).

In this embodiment, voltage levels of the voltages VU0 to VU1023 may be changed by changing voltage levels of the first driving voltage VGMA_UH, the second driving voltage VGMA_UL, and the reference gamma voltages VREFU1 to VREFU10.

Voltage levels of the gray scale voltages Y1 to Ym may be adjusted by changing voltage levels of the first to fourth driving voltages VGMA_UH, VGMA_UL, VGMA_LH, and VGMA_LL, and voltage levels of the reference gamma voltages VREFU1 to VREFU10, and VREFL1 to VREFL10. Accordingly, luminance change of a displayed image caused by converting the first image signal RGB1 into the second image signal RGB2 may be reduced or prevented.

The display device having a configuration described above may change a voltage level of the driving voltage used in the data driver and expand the bit width of an image signal within an effective luminance range, depending on luminance information included in the metadata. Accordingly, a gray scale may be displayed which is expanded beyond a gray scale range a display device may otherwise display. An image may be displayed with a higher resolution of gray-scale than would otherwise be available.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Although embodiments are disclosed herein and specific terms are employed, they should be used and interpreted in a general and descriptive sense, rather than for purposes of limitation. In some embodiments, as is apparent to those skilled in the art at the time of filing of the present disclosure, a feature, characteristic and/or elements described in connection with the specific embodiments may be used alone, or used in combination with the features, characteristics and/or elements described in connection with other embodiments unless otherwise indicated specifically. Therefore, it will be understood by those skilled in the art that various changes in form and details may be made therein without departing from the spirit and scope of the inventive concept disclosed in the following claims and equivalents thereof.

What is claimed is:

1. A display device comprising:

a display panel comprising a plurality of pixels respectively connected to a plurality of gate lines and a plurality of data lines;

a gate driver to drive the plurality of gate lines;

a data driver to drive the plurality of data lines;

a voltage generator to generate at least one driving voltage to be provided to the data driver; and a driving controller to provide a second image signal and a reference gamma selection signal to the data driver, and to control the gate driver, in response to a first image signal and a control signal, wherein the driving controller is configured to output a voltage control signal for changing a voltage level of the at least one driving voltage, and to output the reference gamma selection signal, based on metadata included in the first image signal, and the data driver is configured to receive the reference gamma selection signal and the at least one driving voltage to provide data voltage signals corresponding to the second image signal to the plurality of data lines, wherein the driving controller comprises:

a metadata analysis circuit to analyze the metadata to obtain a maximum luminance signal and a minimum luminance signal;

a bit expansion circuit to convert the first image signal into an expanded image signal between a maximum gray level corresponding to the maximum luminance signal and a minimum gray level corresponding to the minimum luminance signal; and a gamma correction circuit to convert the expanded image signal into the second image signal, wherein the gamma correction circuit is configured to output the voltage control signal and the reference gamma selection signal in response to the maximum luminance signal and the minimum luminance signal, wherein the voltage generator is configured to generate a first driving voltage and a second driving voltage in response to the voltage control signal, and wherein the data driver comprises:

a resistor string to generate a plurality of gamma voltages between the first driving voltage and the second driving voltage;

a reference voltage selection circuit to select some of the plurality of gamma voltages in response to the reference gamma selection signal, and to output the selected gamma voltages as a plurality of reference gamma voltages;

a second voltage generator to generate a plurality of voltages based on the plurality of reference gamma voltages; and a decoder to output voltages, of the plurality of voltages, corresponding to the second image signal as gray scale voltages, wherein the gray scale voltages are respectively provided to the plurality of data lines as the data voltage signals.

2. The display device of claim 1, wherein the second driving voltage has a lower voltage level than the first driving voltage.

3. The display device of claim 1, wherein a voltage level of the first driving voltage is determined depending on the maximum luminance signal, and a voltage level of the second driving voltage is determined depending on the minimum luminance signal.

4. The display device of claim 1, wherein the reference voltage selection circuit comprises a plurality of selectors each of which is configured to receive the plurality of gamma voltages, and to output one of the plurality of gamma voltages as a reference gamma voltage in response to the reference gamma selection signal.

5. The display device of claim 1, wherein the resistor string comprises a plurality of resistors sequentially connected in series between the first driving voltage and the second driving voltage, and configured to output voltages of connecting nodes between the plurality of resistors as the plurality of gamma voltages.

6. The display device of claim 1, wherein the metadata is included in a vertical blanking interval of the first image signal.

7. A display device comprising:

a display panel comprising a plurality of pixels respectively connected to a plurality of gate lines and a plurality of data lines;

a gate driver to drive the plurality of gate lines;

a data driver to drive the plurality of data lines;

a voltage generator to generate at least one driving voltage and a plurality of reference gamma voltages to be provided to the data driver; and a driving controller to provide a second image signal to the data driver, and to control the gate driver, in response to a first image signal, a control signal and metadata, wherein:

the driving controller is configured to output a voltage control signal for changing voltage levels of the at least one driving voltage and the plurality of reference gamma voltages based on luminance information included in the metadata in the first image signal, and the data driver is configured to receive the plurality of reference gamma voltages and the at least one driving voltage to provide data voltage signals corresponding to the second image signal to the plurality of data lines, wherein the voltage generator is configured to generate a first driving voltage and a second driving voltage in response to the voltage control signal, wherein the data driver comprises:

a resistor string to generate a plurality of voltages between the first driving voltage and the second driving voltage based on the plurality of reference gamma voltages; and a decoder to output voltages, of the plurality of voltages, corresponding to the second image signal as gray scale voltages, wherein the gray scale voltages are respectively provided to the plurality of data lines as the data voltage signals.

8. The display device of claim 7, wherein the second driving voltage has a lower voltage level than the first driving voltage, and the plurality of reference gamma voltages has voltage levels different from each other between the first driving voltage and the second driving voltage.

9. The display device of claim 7, wherein the resistor string comprises a plurality of resistors sequentially connected in series between the first driving voltage and the second driving voltage, and configured to output voltages of connecting nodes between the plurality of resistors as the plurality of voltages.

10. The display device of claim 7, wherein the metadata is included in a vertical blanking interval of the first image signal.

* * * * *